US011674370B2

(12) United States Patent
Shelton et al.

(10) Patent No.: US 11,674,370 B2
(45) Date of Patent: Jun. 13, 2023

(54) PERFORATING GUN SYSTEM

(71) Applicants: HARRISON JET GUNS II, L.P., Kennedale, TX (US); PMR GLOBAL, INC., Burleson, TX (US)

(72) Inventors: James F. Shelton, Kennedale, TX (US); Dee Estes, Burleson, TX (US); David Sciuto, Burleson, TX (US)

(73) Assignees: Harrison Jet Guns II, L.P., Kennedale, TX (US); PMR Global, Inc., Burleson, TX (US)

( * ) Notice: Subject to any disclaimer, the term of this patent is extended or adjusted under 35 U.S.C. 154(b) by 0 days.

(21) Appl. No.: 17/544,304

(22) Filed: Dec. 7, 2021

(65) Prior Publication Data

US 2022/0186588 A1 Jun. 16, 2022

Related U.S. Application Data

(60) Provisional application No. 63/123,552, filed on Dec. 10, 2020.

(51) Int. Cl.
*E21B 43/117* (2006.01)
*E21B 43/116* (2006.01)

(52) U.S. Cl.
CPC ..... *E21B 43/117* (2013.01); *E21B 43/116* (2013.01)

(58) Field of Classification Search
CPC ..... E21B 43/116; E21B 43/117
See application file for complete search history.

(56) References Cited

U.S. PATENT DOCUMENTS

| | | | | |
|---|---|---|---|---|
| 10,352,136 | B2 | 7/2019 | Goyeneche | |
| 10,689,955 | B1 * | 6/2020 | Mauldin | F16C 35/06 |
| 11,078,764 | B2 * | 8/2021 | Eitschberger | F42B 3/103 |
| 2019/0292887 | A1 | 9/2019 | Austin, II et al. | |
| 2020/0248535 | A1 * | 8/2020 | Goyeneche | E21B 43/119 |
| 2021/0223007 | A1 * | 7/2021 | Kash | F42B 3/103 |

* cited by examiner

*Primary Examiner* — Yong-Suk (Philip) Ro
(74) *Attorney, Agent, or Firm* — Warner Norcross + Judd LLP

(57) ABSTRACT

An improved perforating gun. The perforating gun includes an internal charge holder formed from a conductive material and comprising a grounding tab. The grounding tab protrudes through a first end cap and is in direct electrical contact with a tandem for grounding the internal charge holder. An optional second grounding tab protrudes through a second end cap and is in direct electrical contact with a second tandem. Each end cap includes a contact pin that engages a signal transfer pin contained within a tandem. The contact pins are biased outwardly by respective compression springs, and each compression spring comprises a portion of an electrical path for a firing signal.

8 Claims, 3 Drawing Sheets

PERFORATING GUN SYSTEM

CROSS-REFERENCE TO RELATED APPLICATIONS

This application claims the benefit of U.S. Provisional Application 63/123,552, filed Dec. 10, 2020, the disclosure of which is incorporated by reference in its entirety.

TECHNICAL FIELD

The present invention relates to perforating gun systems having penetrating shaped charges to generate entrance holes through a wellbore casing.

BACKGROUND

Perforating guns are downhole systems that fire shaped charges through a wellbore casing. When lowered into the wellbore on a wireline opposite a hydrocarbon formation, the gun is fired electrically. Each shaped charge includes an interior cone of material that, when detonated, collapses and is formed into a high-velocity jet that penetrates through the wellbore casing. The resulting perforations allow a fluid (oil or gas) to flow into the wellbore.

Perforating guns are typically manufactured from a steel body with opposing box ends having female threads. Tandems having male threads are threaded to one or both ends of each perforating gun in a gun string. In this fashion, multiple perforating guns can be connected end-to-end and simultaneously detonated within the wellbore as a gun string.

Despite their acceptance, there remains a continued need for improved perforating gun systems. In particular, there remains a continued need for improved perforating gun systems that can be quickly and safely assembled as a gun string, without requiring the manual connecting of firing wires or grounding wires between adjacent components of a gun string.

SUMMARY OF THE INVENTION

An improved perforating gun is provided. The perforating gun includes an internal charge holder formed from a conductive material and comprising a grounding tab. The grounding tab protrudes through a first end cap and is in direct electrical contact with a tandem for grounding the internal charge holder. An optional second grounding tab protrudes through a second end cap and is in direct electrical contact with a second tandem. Each end cap includes a contact pin that engages a signal transfer element contained within a tandem. The contact pins are biased outwardly by respective compression springs, and each compression spring comprises a portion of an electrical path for a firing signal.

In one embodiment, the grounding tab is an integral extension of the internal charge holder. In applications having two grounding tabs, the first grounding tab extends through an opening in the first end cap, and the second grounding tab extends through an opening in the second end cap. The grounding tabs are in direct electrical contact with respective first and second tandems for grounding the internal charge holder. Each grounding tab can include an angled end portion that abuts a conical recess within a tandem. Alternatively, each grounding tab can include a straight (axial) end portion that is received within an annular groove in a tandem.

In another embodiment, a gun string includes two or more perforating guns and a tandem. Each perforating gun includes an internal charge holder within an outer loading tube, a first end cap joined to a first end of the internal charge holder, and a second end cap joined to a second end of the internal charge holder. The first end cap includes a first contact pin, and the second end cap includes a second contact pin. Each contact pin is biased in the axial outward direction by a spring element, thereby providing a positive connection between the contact pin and the signal transfer element and forming part of the electrical path for the firing signal. The firing signal continues to an internal addressable switch and is electrically isolated from the grounding tabs and the internal charge carrier.

The gun string can be assembled on-site by threadably engaging perforating guns and tandems in an alternating sequence. The signal transfer element within each tandem includes a socket for receiving a spring-biased contact pin, such that the signal transfer element is in electrical communication with an addressable switch within the perforating gun. The gun string is then lowered into a wellbore having a wellbore casing, and a firing signal causes the shaped charges to detonate, creating a plurality of perforations through the wellbore casing, optionally followed with the introduction of a hydraulic fracking fluid through the newly formed perforations.

These and other features and advantages of the present invention will become apparent from the following description of the invention, when viewed in accordance with the accompanying drawings and appended claims.

DETAILED DESCRIPTION

The following detailed description is merely exemplary in nature and is not intended to limit the oilfield perforating systems and methods as described herein. Furthermore, there is no intention to be bound by any theory presented in the preceding background or the following detailed description. The description is not in any way meant to limit the scope of any present or subsequent related claims.

As used here, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

Figure 1:
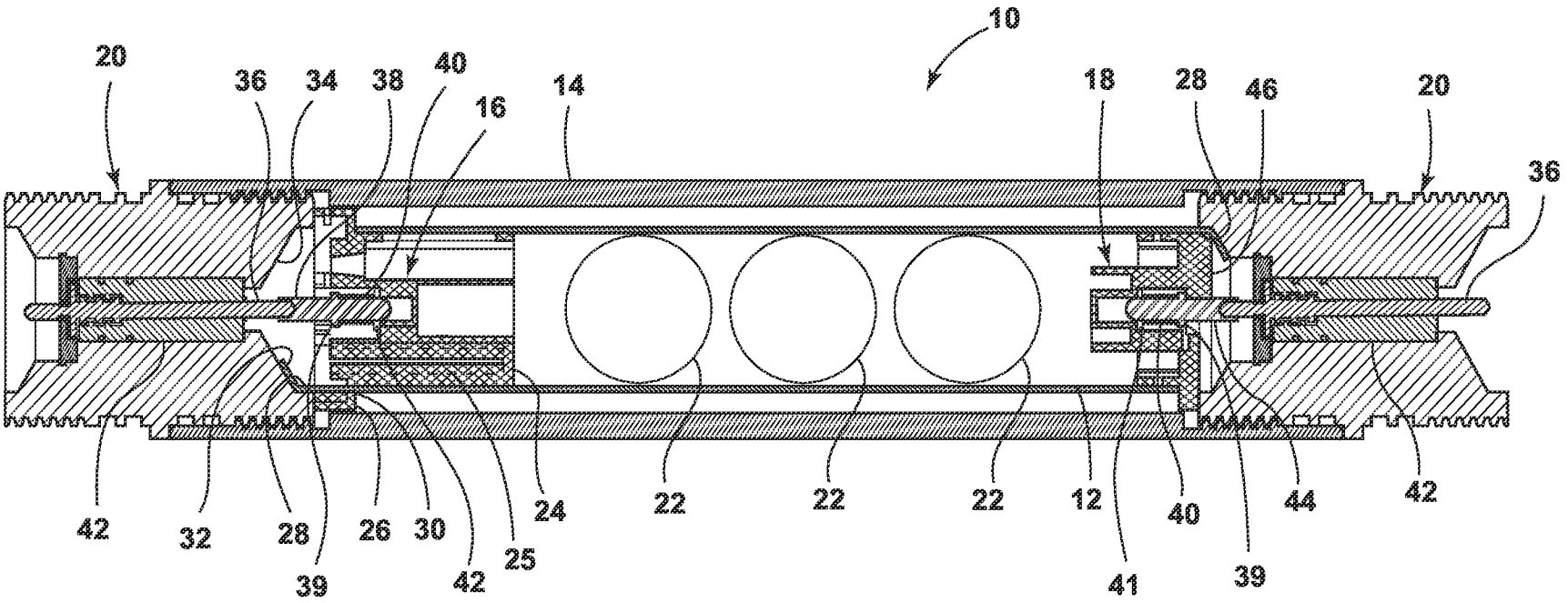
FIG. 1 is a cross-sectional view of a perforating gun in accordance with a first embodiment.

Referring now to FIG. 1, a perforating gun in accordance with a first embodiment is illustrated and generally designated 10. The perforating gun 10 includes an internal charge carrier 12, an outer loading tube 14, a first end cap 16, and a second end cap 18. A tandem 20 is joined to each end of the perforating gun 10, and in particular the opposing box ends of the outer loading tube 14.

The internal charge carrier 12 is generally formed from an electrically conductive material, for example stainless steel, and includes a cylindrical body having multiple shaped charge openings 22 that receive a corresponding number of shaped charges. The openings 22 are in axial alignment with each other in the current embodiment, but can be angularly offset from each other in other embodiments. The internal charge carrier 12 includes three shaped charge openings 22 in the illustrated embodiment, while other embodiments can include greater or fewer number of shaped charge openings.

The shaped charge openings 20 in the internal charge holder 12 are aligned with scalloped recesses (not shown) in the outer loading tube 14. The outer loading tube 14 is generally cylindrical and includes a length that is greater than the length of the internal charge carrier 12, such that the outer loading tube 14 extends beyond the internal charge carrier 12. The outer loading tube 14 includes opposing box ends having female threads. The tandems 20 having male threads and are threaded to respective box ends of the outer loading tube 14 so that two or more perforating guns can be joined in series in a gun string.

Each end cap 16, 18 is made out of an electrically insulating material, for example molded plastic. In addition, each end cap 16, 18 is partially received within the internal charge carrier 12. The first end cap 16 includes an addressable switch housing 24 and a large diameter portion 26. The large diameter portion 26 includes an outer diameter that is approximately equal to the inner diameter of the outer loading tube 14. A first grounding tab 28 is an integral extension of the charge carrier 12 and extends through an opening 30 in the first end cap 16 into engagement with the first tandem 20. A second grounding tab 28 is an integral extension of the charge carrier 12 and extends past the second end cap 18 into engagement with the second tandem 20. The grounding tabs 28 include a bent terminal portion 32 that contacts a conical interior surface 34 of the respective tandem 20. Though two grounding tabs are shown, in other embodiments the second ground tab 28 is omitted.

As also shown in FIG. 1, the first tandem 20 includes a signal transfer pin 36 protruding into a conical recess. A non-conducting sleeve or pass-through housing 42 surrounds the signal transfer pin 36 to ensure the signal transfer pin 36 is electrically isolated from the first tandem 20. The signal transfer pin 36 engages a contact pin 38 that protrudes from the first end cap 16. The contact pin 38 includes a flange 39 that is biased in the axial outward direction by a helical spring 40. The spring 40 provides a positive connection between the contact pin 38 and the signal transfer pin 36 and forms part of the electrical path for the firing signal. In particular, the spring 40 is supported at its opposing end by a contact plate 41, such that an electrical path extends through the contact pin 38 (including its flange 39), the spring 40, and the contact plate 41. The contact plate 41 is ring-shaped and includes an inner diameter greater than the outer diameter of the contact pin 38, such that the contact pin 38 can at least partially pass through the contact plate 41 as shown in FIG. 1. In addition, the contact plate 41 is in electrical communication with the addressable switch for conveying a firing signal to the addressable switch (and ultimately an internal detonator) and for conveying a firing signal to the next adjacent perforating gun in the gun string.

The second tandem 20 is identical to the first tandem 20 and is formed from a conductive material. A signal transfer pin 36 is received within the second tandem 20 and is surrounded by a pass-through housing 42 to electrically isolate the second signal transfer pin 36 from the second tandem 20. The terminal end of the signal transfer pin 36 makes contact with a second contact pin 44 protruding from the second end cap 18. The second end cap 18 includes an insulating end plate 46 with a central opening for the second pressure switch 44. A second end of the charge charrier 12 includes a second grounding tab 28, identical to the first grounding tab 28, for direct electrical connection to the second tandem 20. In other embodiments, however, the second grounding tab 28 is omitted.

Figure 2:
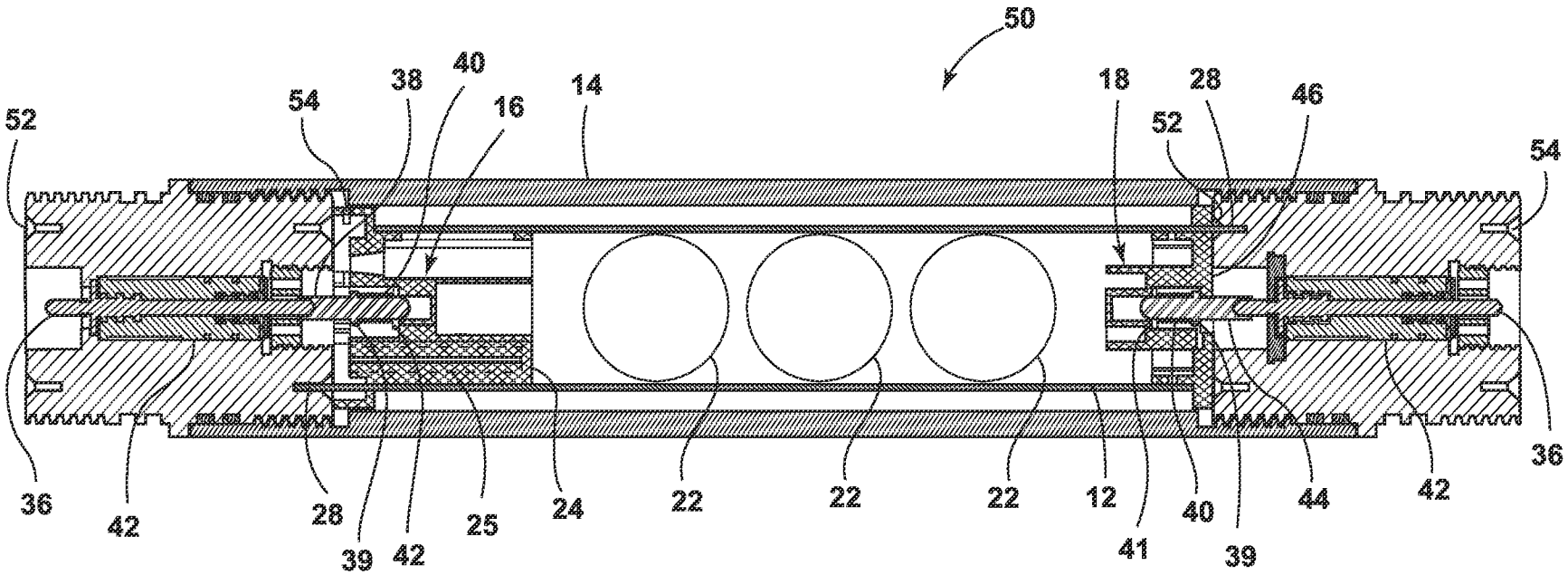
FIG. 2 is a cross-sectional view of a perforating gun in accordance with a second embodiment.

Referring now to FIG. 2, a perforating gun 50 in accordance with a second embodiment is illustrated. The perforating gun 50 of FIG. 2 is similar in structure and function to the perforating gun 10 of FIG. 1, except that the grounding tabs 28 are received within an annular recess in the tandems 20, rather than being bent into engagement with the conical surface 34. In particular, each tandem 20 includes a first annular recess 52 on a first end face and a second annular recess 54 on a second end face, opposite the first end face. The grounding tabs 28 are generally straight, and extend beyond the end caps 16, 18 into engagement with the first annular recess and the second annular recess, respectively. The recesses 52, 54 have sloped sidewalls to guide the grounding tabs 28 during installation.

The perforating gun of FIG. 2 is otherwise similar in structure and function to the perforating gun of FIG. 1. In particular, the perforating gun of FIG. 2 includes a charge carrier 12 with multiple shaped charge openings 22, the charge carrier 12 being received within an outer loading tube 14. The outer loading tube 14 includes a steel body with opposing box ends having female threads. End caps 16, 18 are received within the internal charge carrier 12, with the first end cap 16 including an addressable switch housing 24 and a contact pin 38, and the second end cap 18 including a contact pin 44. The contact pins 38, 44 are biased in the axial outward direction by a helical spring 40 and are electrically isolated from the grounding tabs 28. A non-conducting sleeve or pass-through housing 42 within the each tandem 20 surrounds a signal transfer pin 36 to ensure the signal transfer pin 36 is electrically isolated from the each tandem 20, which is coupled to the grounding tabs 28 as noted above.

In operation, the firing signal is passed through a tandem 20 that interconnects adjacent perforating guns. In particular, the firing signal passes through the signal transfer pin 36 from a first contact pin of a first perforating gun to a second contact pin of a second perforating gun. The firing signal is passed to an addressable switch 25 and is passed to a second signal transfer pin 36 in a second tandem via the second contact pin. A signal fire wire (not shown) extends between the first contact plate and the second contact plate to allow the firing signal to directly passed to adjacent perforating guns.

Figure 3:
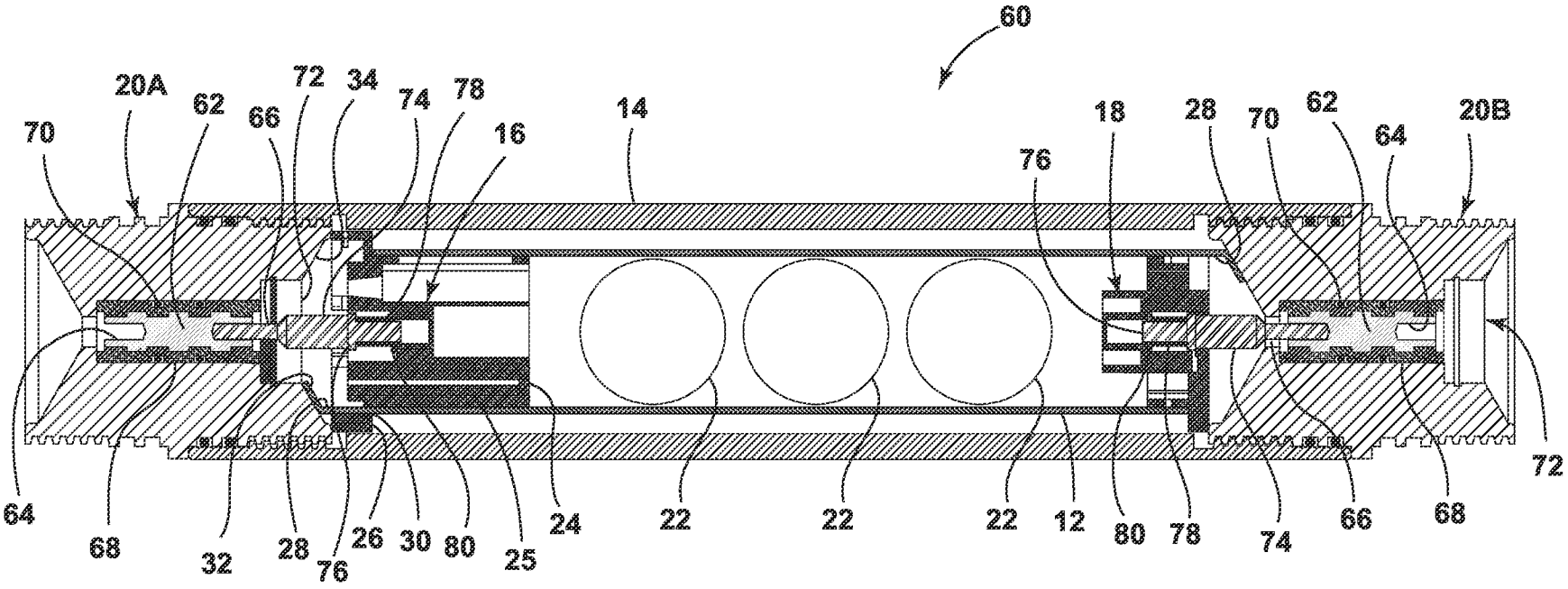
FIG. 3 is a cross-sectional view of a perforating gun in accordance with a third embodiment.

Referring now to FIG. 3, a perforating gun 60 in accordance with a third embodiment is illustrated. The perforating gun 60 of FIG. 3 is similar in structure and function to the perforating gun 10 of FIG. 1, except that the signal transfer pin 36 of FIG. 1 now comprises a signal transfer element 62 defining socket openings 64 on opposing ends thereof. Each socket opening 64 receives a contact pin 66 for passing a firing signal from a first perforating gun to a second perforating gun. The signal transfer element 62 does not protrude from the pass-through housing 68, however, and is instead slightly recessed therein.

In particular, the signal transfer element 62 is surrounded by a pass-through housing 68 that is received within a cylindrical opening in a respective tandem 20A, 20B. The pass-through housing 68 is formed from a non-conductive material to electrically isolate the signal transfer element 62 from the respective tandem 20A, 20B. The pass-through housing 68 includes an inner surface opposite an outer surface. The inner surface is corrugated or ribbed to prevent axial movement of the signal transfer element 62. The outer surface includes at least one o-ring 70 to create a seal with the cylindrical opening the respective tandem 20A, 20B. The pass-through housing 68 is secured within the cylindrical opening by a retainer nut 72. The retainer nut 72 is received within a threaded female opening in a respective tandem 20A, 20B and includes a central opening for a contact pin.

As also shown in FIG. 3, the contact pin 66 protrudes from the first end cap 16 of the perforating gun 60. The contact pin 66 includes a head portion 74 and a stem portion 76, the stem portion 76 being surrounded by a helical spring 78. The head portion 74 extends through the retainer nut 72 and is biased in the axial outward direction by the helical spring 78 to provide a positive connection between the contact pin 66 and the signal transfer element 62. The spring 78 is supported at its opposite end by a contact plate 80, such that an electrical path extends through the contact pin 66, the spring 78, and the contact plate 80. In addition, the contact plate 80 is in electrical communication with the addressable switch 25 for conveying a firing signal to the addressable switch (and ultimately an internal detonator) and for conveying a firing signal to the next adjacent perforating gun in the gun string.

The perforating gun 60 is joined to a second tandem 20B that is identical to the first tandem 20A and is formed from a conductive material. A signal transfer element 62 is received within the second tandem 20B and is surrounded by a pass-through housing 68 to electrically isolate the second signal transfer element 62 from the second tandem 20B. The socket opening 64 receives the second contact pin 66 protruding from the second end cap 18. The second contact pin 66 includes a head portion 74 and a stem portion 76 surrounded by a helical spring 78. The head portion 74 of the second contact pin extends 66 is biased in the axial outward direction by the helical spring 78 to provide a positive connection between the contact pin 66 and the signal transfer element 62 within the second tandem 20B.

In operation, the firing signal is passed through the first tandem 20A to the perforating gun 60 and subsequently to the second tandem 20B (to adjacent perforating gun). In particular, the firing signal passes through the signal transfer element 62 to a first contact pin of the perforating gun 60. The firing signal is passed to an addressable switch 25 and is passed by a second contact pin 66 to a second signal transfer element 62 in the second tandem 20B. A signal fire wire (not shown) extends between the first contact plate 80 and the second contact plate 80 to allow the firing signal to directly passed to adjacent perforating guns.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

What is claimed is:

1. A perforating gun comprising:

an outer loading tube including a first box end opposite a second box end for threadably engaging a first tandem and a second tandem, respectively;

an internal charge holder within the outer loading tube for receiving a plurality of shaped charges, the internal charge holder being formed from a conductive material;

a first end cap joined to a first end of the internal charge holder, the first end cap including a first contact pin biased axially outward by a first spring;

a second end cap joined to a second end of the internal charge holder, the second end cap including a second contact pin biased axially outward by a second spring;

wherein the first and second end caps are formed from a non-conductive material and wherein the first and second contact pins are formed from a conductive material, wherein the first spring and the second spring are in electrical contact with the first contact pin and the second contact pin, respectively, and comprise at least a portion of an electrical path for a firing signal.

2. The perforating gun of claim 1 wherein the first spring is supported against a first contact plate first and the second spring is supported against a second contact plate.

3. The perforating gun of claim 1 wherein the first and second tandems include an electrically conductive signal transfer pin within a non-conducting pass-through housing.

4. The perforating gun of claim 1 wherein the first and second end caps are formed from a polymer resin and wherein the internal charge holder is formed from metal.

5. The perforating gun of claim 1 wherein the first end cap includes an integral housing for an addressable switch.

6. A perforating gun system comprising:

a perforating gun; and first and second tandems joined to opposing ends of the perforating gun;

wherein the perforating gun includes:

an outer loading tube including a first box end opposite a second box end, an internal charge holder within the outer loading tube, a first end cap joined to a first end of the internal charge holder, the first end cap including a first contact pin biased axially outward by a first spring, a second end cap joined to a second end of the internal charge holder, the second end cap including a second contact pin biased axially outward by a second spring, wherein the first and second end caps are formed from a non-conductive material and wherein the first and second contact pins are formed from a conductive material, wherein the first spring and the second spring are in electrical contact with the first contact pin and the second contact pin, respectively, and comprise a portion of an electrical path from the first contact pin to the second contact pin.

7. The perforating gun system of claim 6 wherein the first and second springs surround a portion of the first and second contact pins, respectively.

8. The perforating gun system of claim 6 wherein the first and second tandems include an electrically conductive signal transfer pin within a non-conducting pass-through housing.

* * * * *